US009803905B2

(12) United States Patent
Wang

(10) Patent No.: US 9,803,905 B2
(45) Date of Patent: Oct. 31, 2017

(54) DEHUMIDIFIER WITH TEMPERATURE SENSOR SAFETY FEATURE

(71) Applicant: Zhiming Wang, City of Industry, CA (US)

(72) Inventor: Zhiming Wang, City of Industry, CA (US)

( * ) Notice: Subject to any disclaimer, the term of this patent is extended or adjusted under 35 U.S.C. 154(b) by 303 days.

(21) Appl. No.: 14/641,388

(22) Filed: Mar. 8, 2015

(65) Prior Publication Data

US 2015/0184874 A1 Jul. 2, 2015

(51) Int. Cl.
*F25B 49/02* (2006.01)
*F24F 3/14* (2006.01)

(52) U.S. Cl.
CPC ..... *F25B 49/022* (2013.01); *F24F 3/1405* (2013.01); *F24F 2003/144* (2013.01)

(58) Field of Classification Search
CPC ..... F25B 49/022; F25B 2500/06; F25B 2500/08; F25B 2600/01; F25B 2600/02; F24F 3/1405; F24F 2003/144
See application file for complete search history.

(56) References Cited

U.S. PATENT DOCUMENTS

| | | | | |
|---|---|---|---|---|
| 4,939,909 | A | 7/1990 | Tsuchiyama | |
| 6,085,530 | A | 7/2000 | Barito | |
| 9,168,315 | B1 * | 10/2015 | Scaringe | F25B 49/02 |
| 2003/0066298 | A1 | 4/2003 | Yang | |

FOREIGN PATENT DOCUMENTS

JP 08068576 A * 3/1996

* cited by examiner

*Primary Examiner* — Marc Norman
(74) *Attorney, Agent, or Firm* — The Law Office of Scot S. Fagerland

(57) ABSTRACT

We provided a dehumidifier with a temperature-sensing safety feature. The temperature probe is in direct contact with the discharge tube, as opposed to the industry standard of measuring temperature at the evaporator. In case the discharge tube overheats, it causes the resistance of the temperature probe to increase above a threshold value. The temperature probe then sends a signal to pause operation of the compressor. In a preferred embodiment, the compressor resumes operation when the temperature returns to normal, unless it overheats repeatedly. The temperature probe remains intact and may be used indefinitely. In preferred embodiments, the temperature-sensing safety feature is combined with a timing safety feature and/or a current-sensing safety feature.

4 Claims, 4 Drawing Sheets

DEHUMIDIFIER WITH TEMPERATURE SENSOR SAFETY FEATURE

1. FIELD OF THE INVENTION

This invention is in the field of humidity regulation, specifically safety override of a dehumidifier by monitoring temperature in the compressor.

2. BACKGROUND OF THE INVENTION

A dehumidifier is a unit similar to an air conditioner or refrigerator. A fan draws air from the room across a cold evaporator and then a hot condenser. In the evaporator, the air is cooled, and the moisture condenses and is collected. The dry air is then reheated in the condenser on its way out of the dehumidifier unit. A closed tubing, system containing a refrigerant is responsible for keeping the condenser hot and the evaporator cool. The refrigerant is compressed in a compressor, and then forced through a discharge tube into the condenser coil.

Dehumidifiers are often left unattended in unoccupied rooms, or set to run continuously overnight. Problems can occur when a dehumidifier unit operates too long or runs low on refrigerant. Overly prolonged use can lead to mechanical failure, rupture, meltdown, or fire. This invention provides an improved dehumidifier control system. Based on the temperature at the discharge tube, this system interrupts the operation of the compressor if it gets too hot.

3. ADVANTAGES OVER PRIOR ART

Refrigerant leakage, blockage in the compressor cylinder, or damage to the fan motor can lead to carbonized leads in all electric, parts and an abnormal spike in compressor temperature. These conditions create a fire hazard. Dehumidifiers now on the market mount a temperature sensor on the evaporator. A temperature probe on the evaporator does not effectively monitor the operating condition of the compressor, which is the source of dangerous malfunctions.

The present invention mounts a temperature sensor directly on the discharge tube leading out of the compressor into the condenser. This is a much more direct indicator of compressor failure.

U.S. Pat. No. 6,085,530 (Barito/Scroll Technologies) discloses a system that shuts down a compressor when the refrigerant or "charge" runs too low. In this system, a safety device melts or becomes physically destroyed when the refrigerant runs low and the compressor becomes excessively hot. Destruction of this safety device sends a signal to stop the compressor motor. "The compressor cannot be restarted until a repair person is directed to the compressor to replace the portions of the compressor which are causing the loss of charge." (Barito Column 1, lines 45-47). In claims 3 and 7, the safety device is described as a "heat fusible link" mounted on the discharge tube. In claim 4, the safety device is located "on a portion of the compressor canister at discharge pressure" and is limited as "requiring manual resetting to re-start said motor after said shut down occurs." The other claims of the Scroll patent do not refer to the discharge tube. Nowhere does the Scroll patent specifically refer to a dehumidifier.

The present invention is more tailored to a home-use dehumidifier. It can respond not only to loss of charge but to other problems that may cause compressor overheating, such as cylinder blockage or fan motor malfunction. More importantly, our safety mechanism is not destroyed in the process of shutting down the compressor. It is electronic, resets automatically, and may be reused an indefinite number of times without replacement.

Furthermore, we combine the temperature sensor safety feature with other dehumidifier safety features that have not previously been offered together in a single product. We offer a timing feature and a current-detection feature. A timing feature is disclosed in US patent application 2003/0066298 (Yang/Azalea Microelectronics Corp). A current-detection feature is disclosed in U.S. Pat. No. 4,939,909 (Tsuchiyama and Hosoya/Sanyo). The Sanyo patent is for an air conditioner, not a dehumidifier. We do not claim the timing, feature or the current-detection feature by themselves, but only combinations including the temperature-sensing feature.

4. SUMMARY OF THE INVENTION

The primary feature is the temperature sensor safety feature, which works by securing a. temperature probe to the discharge tube.

The temperature measuring sensor includes a temperature probe, lead, and plug wire ports. The temperature probe is welded onto the compressor discharge tube. The plug wire ports are connected to the dehumidifier's main microcontroller. The temperature probe has the property that, when its temperature increases, its electrical resistance decreases. When the discharge tube temperature is too high and the probe's resistance decreases below a threshold, the microcontroller transfers a signal to stop the compressor motor.

When the temperature measuring probe measures effectively that the discharge temperature is normal, the microcontroller returns the machine to its normal state of operation. If the discharge tube's temperature starts experiencing multiple abnormalities, the microcontroller will instruct the machine to stop operating. An error code will then be displayed on the dehumidifier's control panel.

A secondary feature is a timing safety feature. The dehumidifier runs continuously until a pre-set time. The microcontroller then transmits a signal to a driver chip, setting a compressor relay to a shutdown protection suite by sending a command through the lead port of the compressor control. After the shutdown period is complete, the compressor relay closes, and the compressor reconnects fir continuous operation. This provides a cycle of activity and rest, effectively "preventive maintenance." important for reliability and longevity of the dehumidifier unit.

An additional secondary feature is a current sensor safety feature. This feature utilizes a current-transformer protective device. Common problems such as refrigerant leakage, poor compressor quality, cylinder blockage, damaged fans, stalled motors, etc. can result in current surges. A power surge can damage the unit or lead to fires. In the present invention, a current transformer converts a current into a voltage signal and sends it to the microcontroller by measuring the current through the compressor via a peripheral circuit. After the compressor runs for a set time value, the microcontroller samples a corresponding digital value according to the voltage signal. When the digital value is too high, a signal is relayed from the microcontroller to the driver chip and then to the compressor relay, and the machine stops running. This feature provides effective trip protection, making sure that no fire shall occur due to overcurrent.

5. BRIEF DESCRIPTION OF THE DRAWINGS

6. DETAILED DESCRIPTION OF THE PREFERRED EMBODIMENTS

Figure 1:
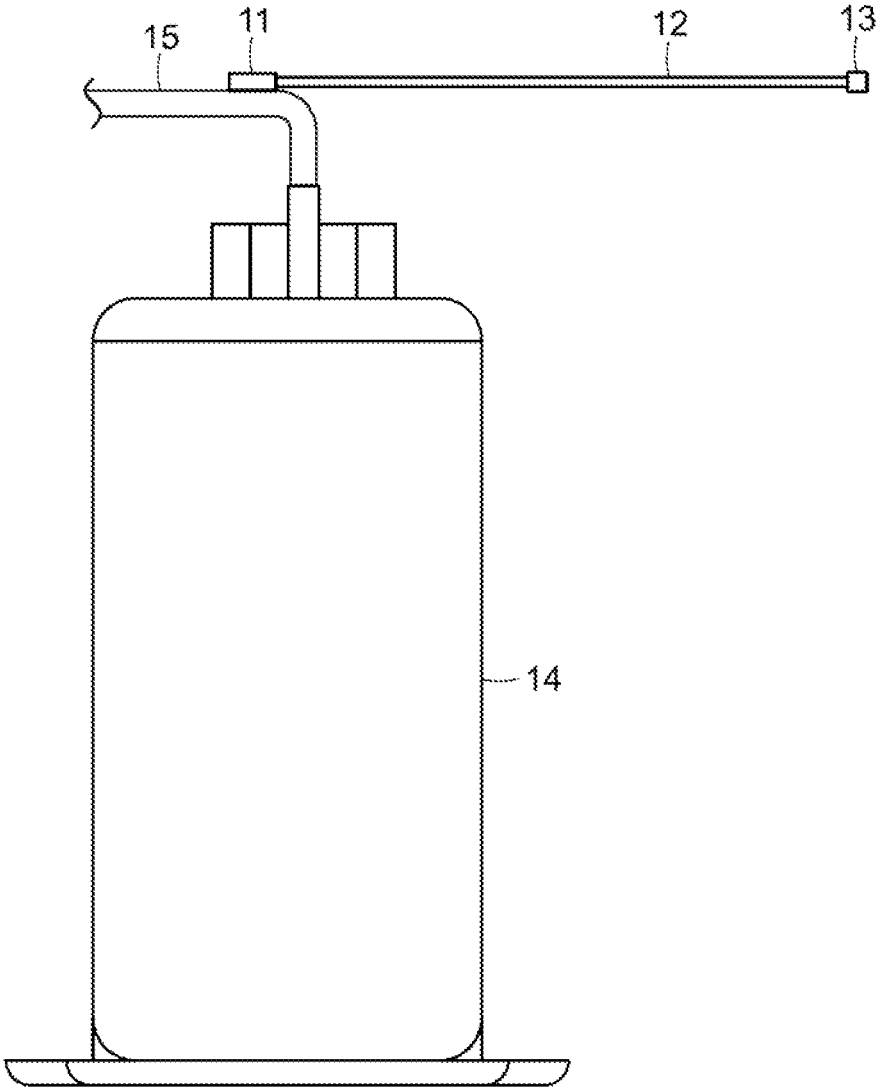
FIG. 1 shows the external physical structure of the dehumidifier compressor with the temperature sensor safety feature in place.

FIG. 1 is relevant for the primary feature, the temperature sensor safety feature. The temperature sensor comprises a temperature probe (11), lead (12), and plug, wire port (13). The temperature probe has the property that, when its temperature increases, its electrical resistance decreases. For example, the temperature probe could be a thermistor with a negative temperature coefficient. A preset threshold resistance level indicates the safe range of operating temperature. The temperature probe is mounted to the discharge tube (15) leading out of the compressor (14). Information about the temperature probe's resistance, and thus its temperature, is conveyed through the lead and the plug wire port into the dehumidifier's microcontroller (21), shown in the circuitry of FIG. 2. When the temperature probe falls below its threshold resistance level, it passes a signal to the microcontroller that the discharge tube is too hot. This is called the overheating signal. The microcontroller then sends a signal to pause operation of the compressor (14).

Unlike the Barito invention as limited in claims 3, 4, and 7, our temperature probe is not destroyed by overheating. After the discharge tube (15) cools to normal operating temperature, the resistance of the temperature probe (11) increases. When the resistance of the temperature probe rises above its threshold resistance level, it sends a signal to the microcontroller indicating that the discharge tube has returned to normal operating temperature. This is called a normal-temperature signal. The microcontroller (21) then sends a signal to resume operation of the compressor (14). If overheating continues recurringly, the microcontroller finally sends a signal to halt operation of the compressor. The microcontroller also sends an error code to be displayed on the control panel (not shown). At that point, the user should check the dehumidifier for recharging or other maintenance. After the problem is resolved, the temperature probe does not need to be repaired or replaced. It is still intact for continued use.

Figure 2:
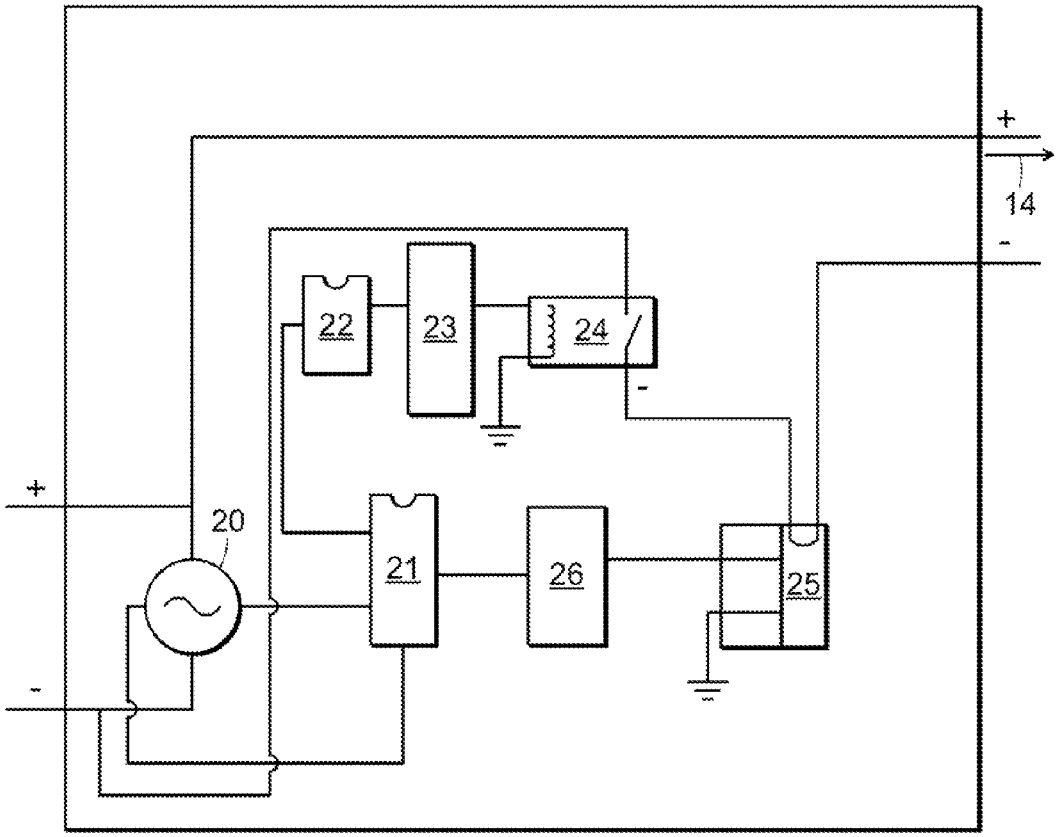
FIG. 2 is an electronic diagram showing all relevant components for the temperature sensor, timing, and current sensor safety features.
Figure 3:
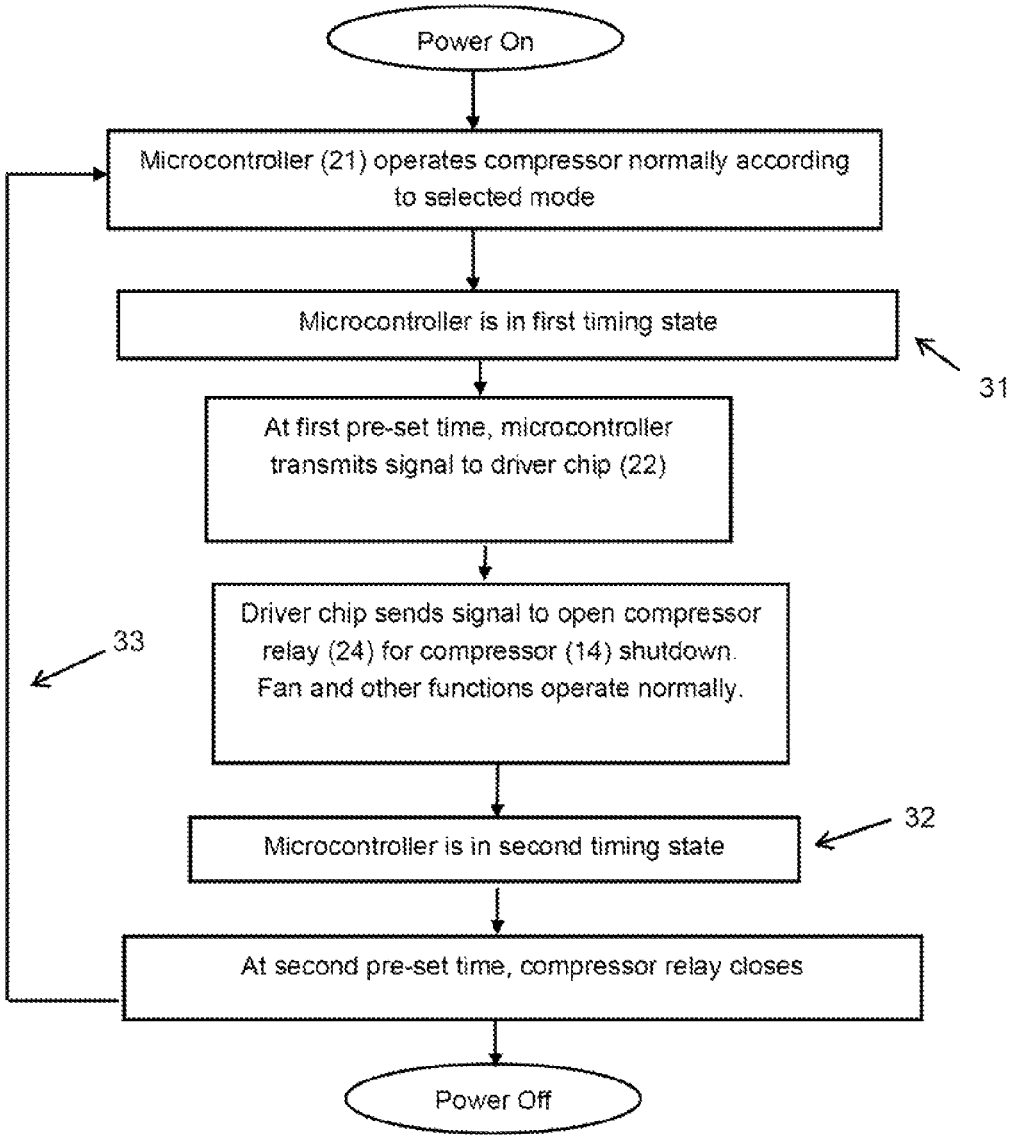
FIG. 3 is a flowchart of operation for the timing safety feature.

The electronics of FIG. 2 include the components necessary for the secondary timing safety feature. FIG. 3 summarizes the sequence of steps for this safety feature. When the power (20) is turned on, the microcontroller (21) operates the compressor (14) normally according to the user's selected mode and the ambient humidity level. The microcontroller is in a first timing state (31), which means that it is counting, down a first pre-set time. Barring any system failures, the dehumidifier runs continuously until the first pre-set time is reached. The microcontroller then transmits a signal to a driver chip (22), setting a compressor relay (24) to a shutdown protection state by sending a command through the lead port of the compressor control (23). The microcontroller is now in a second timing state (32), which means that it is counting down a second pre-set time. After the second pre-set time has elapsed, the compressor relay closes, and the compressor reconnects for continuous operation. This cycle continues (33) until the power is shut down.

Figure 4:
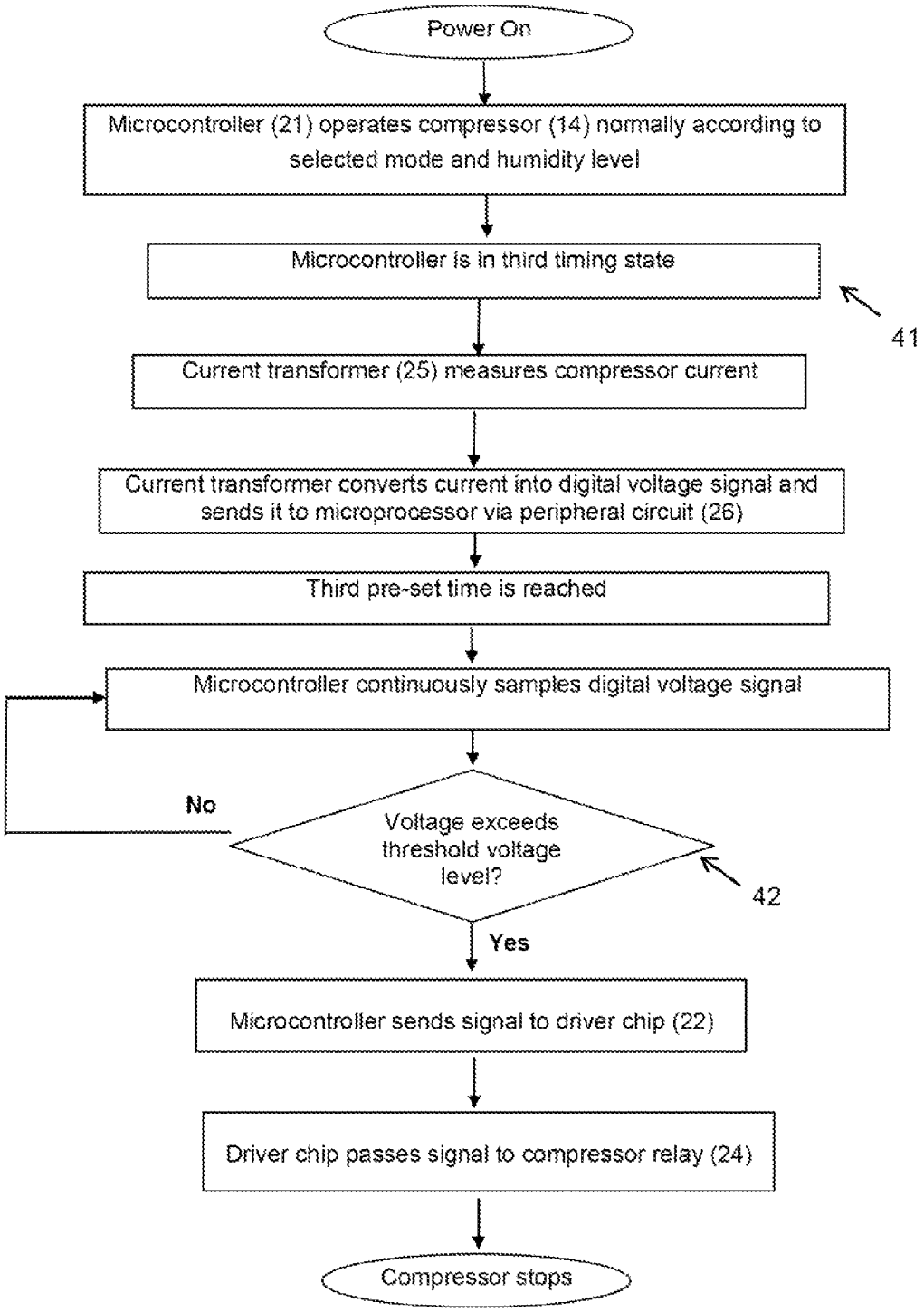
FIG. 4 is a flowchart of operation for the current sensor safety feature.

The electronics of FIG. 2 also include the components necessary for the secondary current detector safety feature. FIG. 4 summarizes the sequence of steps for this safety feature. After the power (20) is turned on, the microcontroller (21) controls the compressor (14) according to humidity and mode. The microcontroller is in a third timing state (41), meaning that it times down a third pre-set time. A current transformer (25) measures the current through the compressor (14). The current transformer converts the compressor current into a voltage signal and sends it to the microcontroller via a peripheral circuit (26). When the third pre-set time is reached, the microcontroller begins to continuously sample the voltage signal. If the voltage ever exceeds a pre-set threshold called the threshold voltage level (42), a signal is relayed from the microcontroller to the driver chip (22) and then to the compressor relay (24), and the machine stops running.

In the claims, the terms that follow are defined as presented above in the context of the invention:

Compressor, compressor relay, control panel, current detector safety feature, current transformer, dehumidifier, driver chip, first pre-set time, lead, lead port of compressor control, microcontroller, normal-temperature signal, overheating signal, peripheral circuit, plug wire ports, second pre-set time, temperature measuring sensor, temperature probe, temperature sensor, temperature sensor safety feature, third pre-set time, threshold resistance level, threshold voltage level, timing safety feature, voltage signal.

I claim:

1. A dehumidifier with a temperature sensor safety feature and a timing safety feature, comprising:

a compressor, a discharge tube, and a control panel;

a microcontroller for electronic control of the dehumidifier;

a temperature measuring sensor comprising a temperature probe in contact with the discharge tube, plug wire ports connected to the microcontroller, and a lead allowing transfer of an electric signal from the temperature probe to the plug wire ports;

a threshold resistance level for the temperature probe;

wherein an increase in discharge tube temperature causing the resistance of the temperature probe to fall below its threshold resistance level causes an overheating signal to pass to the microcontroller;

and wherein the microcontroller is programmed to pause operation of the compressor when the microcontroller receives the overheating signal;

and wherein the temperature probe remains intact after discharge tube overheating;

a driver chip connected to the microcontroller;

a lead port of compressor control connected to the driver chip;

a compressor relay connected to the lead port of compressor control;

wherein the microcontroller is programmed with a first pre-set time for operation and a second pre-set time for pauses;

and wherein, when the first pre-set time is reached, the microcontroller transmits a signal to the driver chip, causing the compressor relay to open by sending a command through the lead port of the compressor control;

and wherein, when the second pre-set time is reached, the microcontroller transmits a signal to the driver chip, causing the compressor relay to close by sending a command through the lead port of the compressor control;

and wherein the compressor can operate if and only if the compressor relay is closed;

and wherein the opening and closing of the compressor relay repeat in a cycle until the power supply is shut off.

2. A dehumidifier with a temperature sensor safety feature and a current detector safety feature, comprising a compressor, a discharge tube, and a control panel;

a microcontroller for electronic control of the dehumidifier;

a temperature measuring sensor comprising a temperature probe in contact with the discharge tube, plug wire ports connected to the microcontroller, and a lead allowing transfer of an electric signal from the temperature probe to the plug wire ports;

a threshold resistance level for the temperature probe;

wherein an increase in discharge tube temperature causing the resistance of the temperature probe to fall below its threshold resistance level causes an overheating signal to pass to the microcontroller;

and wherein the microcontroller is programmed to pause operation of the compressor when the microcontroller receives the overheating signal;

and wherein the temperature probe remains intact after discharge tube overheating;

a driver chip connected to the microcontroller;

a compressor relay connected to the driver chip;

a current transformer;

a peripheral circuit;

wherein the current transformer converts the current through the compressor into a voltage signal and relays the voltage signal to the microcontroller via the peripheral circuit;

and wherein the microcontroller is programmed with a threshold voltage level;

and wherein, if the voltage signal ever exceeds the threshold voltage level, the microcontroller transmits a signal to the driver chip, causing the compressor relay to open, thereby halting operation of the compressor;

and wherein, when the first pre-set time is reached, the microcontroller transmits a signal to the driver chip, causing the compressor relay to open by sending a command through the lead port of the compressor control;

and wherein, when the second pre-set time is reached, the microcontroller transmits a signal to the driver chip, causing the compressor relay to close by sending a command through the lead port of the compressor control;

and wherein the compressor can operate if and only if the compressor relay is closed;

and wherein the opening and closing of the compressor relay repeat in a cycle until the power supply is shut off.

3. A dehumidifier with a timing safety feature, comprising a compressor, a discharge tube, and a control panel;

a microcontroller for electronic control of the dehumidifier;

a driver chip connected to the microcontroller;

a lead port of compressor control connected to the driver chip;

a compressor relay connected to the lead port of compressor control;

wherein the microcontroller is programmed with a first pre-set time for operation and a second pre-set time for pauses;

and wherein, when the first pre-set time is reached, the microcontroller transmits a signal to the driver chip, causing the compressor relay to open by sending a command through the lead port of the compressor control;

and wherein, when the second pre-set time is reached, the microcontroller transmits a signal to the driver chip, causing the compressor relay to close by sending a command through the lead port of the compressor control;

and wherein the compressor can operate if and only if the compressor relay is closed;

and wherein the opening and closing of the compressor relay repeat in a cycle until the power supply is shut off.

4. A dehumidifier with a current detector safety feature, comprising a compressor, a discharge tube, and a control panel;

a microcontroller for electronic control of the dehumidifier;

a driver chip connected to the microcontroller;

a compressor relay connected to the driver chip;

a current transformer;

a peripheral circuit;

wherein the current transformer converts the current through the compressor into a voltage signal and relays the voltage signal to the microcontroller via the peripheral circuit;

and wherein the microcontroller is programmed with a threshold voltage level;

and wherein, if the voltage signal ever exceeds the threshold voltage level, the microcontroller transmits a signal to the driver chip, causing the compressor relay to open, thereby halting operation of the compressor;

and wherein, when the first pre-set time is reached, the microcontroller transmits a signal to the driver chip, causing the compressor relay to open by sending a command through the lead port of the compressor control;

and wherein, when the second pre-set time is reached, the microcontroller transmits a signal to the driver chip, causing the compressor relay to close by sending a command through the lead port of the compressor control;

and wherein the compressor can operate if and only if the compressor relay is closed;

and wherein the opening and closing of the compressor relay repeat in a cycle until the power supply is shut off.

* * * * *